United States Patent [19]

van Bogaert et al.

[11] Patent Number: 4,821,781

[45] Date of Patent: Apr. 18, 1989

[54] WEFT ACCUMULATING METHOD AND ASSEMBLY FOR WEAVING MACHINES

[75] Inventors: Philippe van Bogaert, Schaerbeek; Frank Ampe, Leffinge-Middelkerke; Jozef Verhulst, Zillebeke; Luc Weymeels, Ronse; Hugo Markey, Langemark, all of Belgium

[73] Assignee: Picanol N.V., Ieper, Belgium

[21] Appl. No.: 113,060

[22] Filed: Oct. 27, 1987

[30] Foreign Application Priority Data

Oct. 31, 1986 [NL] Netherlands ..... 8602741

[51] Int. Cl.[4] ..... D03D 47/30; D03D 47/36

[52] U.S. Cl. ..... 139/435; 139/452

[58] Field of Search ..... 139/435, 452; 226/97

[56] References Cited

U.S. PATENT DOCUMENTS

| | | | |
|---|---|---|---|
| Re. 30,318 | 7/1980 | Klinecky et al. | 139/452 |
| 3,669,328 | 6/1972 | Castelli | 139/452 |
| 3,712,526 | 1/1973 | Hanousek et al. | 139/452 |
| 3,799,211 | 3/1974 | Klinecky et al. | 139/452 |
| 3,916,935 | 11/1975 | Keldany | 139/452 |
| 4,479,518 | 10/1984 | Kiwior | 139/452 |

FOREIGN PATENT DOCUMENTS

| | | |
|---|---|---|
| 590477 | 6/1925 | France . |
| 1449084 | 7/1966 | France . |
| 409816 | 12/1962 | Switzerland . |
| 1165624 | 10/1969 | United Kingdom . |
| 1385005 | 2/1975 | United Kingdom . |

*Primary Examiner*—Henry S. Jaudon

*Attorney, Agent, or Firm*—Bacon & Thomas

[57] ABSTRACT

A weft accumulating method and assembly of a weaving loom for accumulating a lenght of weft thread to be inserted into a shed by a pick insertion assembly of the loom in which the accumulator comprises a weft supply; includes a drawing off device off a predetermined length of weft thread from the supply; at least one perforated cylindrical tube; a fluid blowing device to blow the drawn off weft through the tube; and a clamping device to open and close the end of the tube to accumulate weft thread in the tube when the device is closed and to supply the weft thread to the pick insertion assembly when the device is open.

18 Claims, 3 Drawing Sheets

Fig. 6
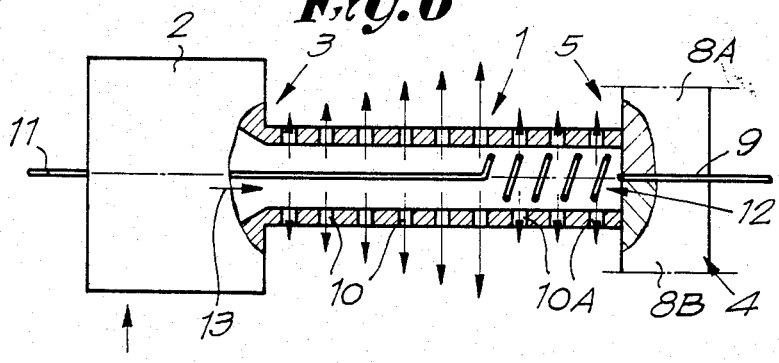
Fig. 7
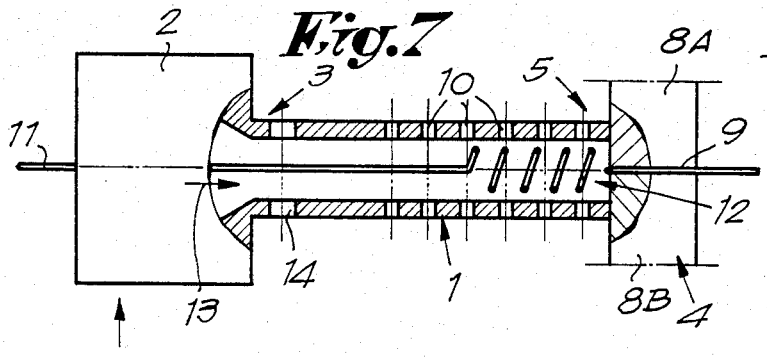
Fig. 8
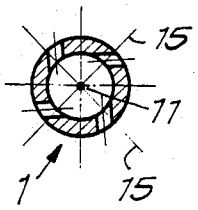
Fig. 9
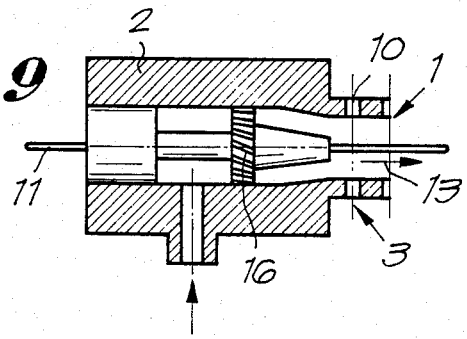
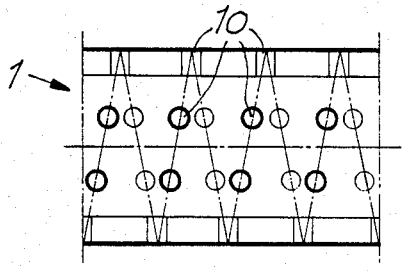
Fig. 10

1A
1B
2
3
4
5
8A
8B
9
10
11
12
13
17
18
19
L1
L2

1
2
3
4
5
8A
8B
9
10
11
12
13
17
18
19

WEFT ACCUMULATING METHOD AND ASSEMBLY FOR WEAVING MACHINES

This invention concerns a weft accumulating method and assembly for weaving machines, namely a method and device to accumulate an intermediate supply of weft thread when thread is being led from a bobbin or other weft supply package to the shed.

BACKGROUND OF THE INVENTION

Accumulating an intermediate supply of weft thread for insertion into the shed is known in the art, the main object being to ensure a continuous speed of unwinding of the weft from the weft supply package while still enabling the pick to be inserted into the shed in a discontinuous manner.

Various types of weft accumulator systems are known. These are described below.

Certain types of weft accumulators are known in which a free loop is formed in the weft yarn. Such a device is described, for example, in the Swiss pat. No. 409,816 in which the weft thread is blown into a free loop by means of an airstream. The next pick insertion then pulls the loop straight again. The main disadvantage of this system is that when the pick is inserted, the thread has to be pulled straight against the force of the airstream, and so has to overcome a fairly strong resistance.

Another very common type of weft accumulator uses a weft prewinder. In this system, the weft thread is wound temporarily on a prewinder drum, and is then taken from the drum when the next pick is inserted. It is well known that the resistance necessary to pull the thread free from the prewinder drum is fairly great, thus limiting the thread velocity during picking.

In yet other known types of weft accumulator system, the weft thread is deposed in a mainly zigzag pattern on a flat surface, in other words forming several free loops. Such a system is described, for example in the French pat. No. 590,477, in which the weft thread is placed on a moving belt. The most important disadvantage of this type of accumulator is that the loops offer a large resistance when they are drawn off the belt, since the belt cannot be perfectly smooth. A certain amount of roughness of the belt surface is necessary to prevent the loops slipping off or piling up together when they are laid on the belt. Other disadvantages include wear and tear of the parts, since a mechanical drive is required, and the accumulation of dust, since the system is necessarily open.

In another system, described in the French pat. No. 1,449,084, an intermediate supply is accumulated by placing the weft thread in a stretched condition in a perforated tube.

SUMMARY OF THE INVENTION

One of the objects of the present invention is to avoid all of the above disadvantages.

Another object to the present invention is to provide a weft accumulating method and assembly that guarantees a number of advantageous characteristics. The primary characteristics are: the weft accumulator described in the invention takes up little space; the resistance encountered in drawing off the thread from the accumulator to insert a pick in the present method is so low it is almost negligible; the thread cannot become tangled in the present method and assembly; and the system can be used for most types and thickness of thread.

The present invention also concerns a weft accumulator system for weaving machines with the advantage that it primarily comprises the combination of:

(a) a means for drawing off a predetermined length of weft thread at a predetermined speed from a weft thread supply package, and (b) at least one perforated, cylindrical tube, one end of which is fitted with an airblower for blowing a quantity of thread (the maximum length being equal to one pick) into the tube, and the other end of which has a thread clamp or thread stopper device through which the thread is led out of the tube.

The above mentioned advantages are achieved by means of a preferred method and embodiment of the present invention characterized by the use of a perforated cylindrical tube with a very small internal diameter, of the order of 10 mm or smaller.

BRIEF DESCRIPTION OF THE DRAWINGS

In order to explain the characteristics of the invention, for the sake of example only and without being limitative in any way, the following preferred embodiments are described below with reference to the accompanying drawings, where:

FIGS. 5 and 6 illustrate the operation of the system of the invention;

FIG. 7 shows another embodiment of the accumulator system of the invention, according to a similar view as in FIG. 2;

FIG. 8 shows a cross-section of another embodiment of the cylindrical tube;

FIG. 9 shows an airblower device which is preferably used in the weft accumulator system of the invention;

FIG. 10 shows another embodiment of the arrangement of the holes in the perforated cylindrical tube;

DESCRIPTION OF THE PREFERRED EMBODIMENTS

Figure 1:
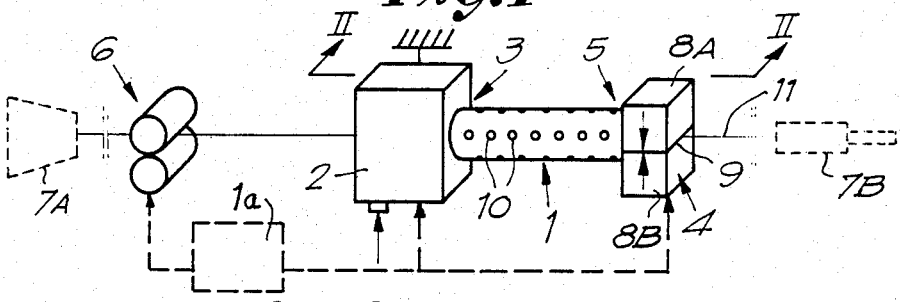
FIG. 1 is a schematic representing the weft accumulator system of the invention.

As can be seen in FIGS. 1–4, the weft accumulator assembly of the invention consists in principle of at least one perforated cylidrical tube 1, a control unit 1a to control the operation of the assembly, an airblower 2 mounted on one end 3 of the tube 1 with the nozzle pointing into the tube 1, and a thread clamp or thread stopper 4 mounted on the opposite end of the tube 5. A means for drawing off weft thread from the weft supply package 7A is also provided, e.g., the rollers 6.

FIG. 1 also shows how the accumulator is positioned with respect to certain other conventional parts of the weaving machine 7 which are known in the art, in particular the weft supply package 7A and the main nozzle 7B. The weft accumulator should preferably be constructed so that the blower 2 and the thread clamp 4 fit on the ends 3 and 5 of the tube 1, and so form the end closures of the tube.

The airblower 3 can of course be a conventional injector. The yarn clamp 4 in its simplest form can consist of two rectangular brake shoes or clamping blocks 8A and 8B whose plane of contact 9 lies in the diameter of the tube 1 and is preferably horizontal.

Figure 2:
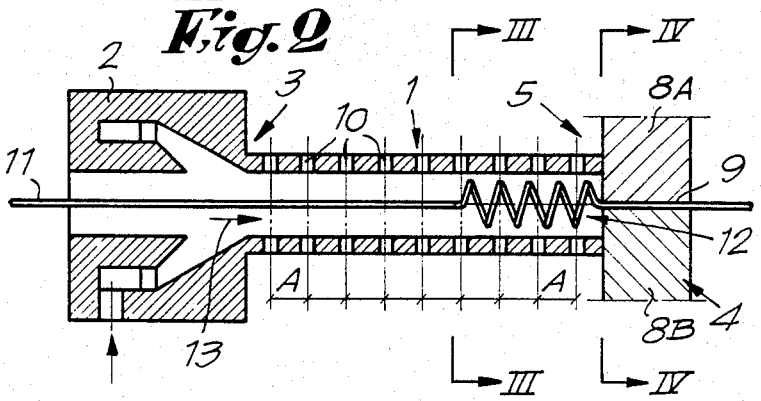
FIG. 2 shows a cross-section of the cylindrical tube along the line II—II in FIG. 1.
Figure 3:
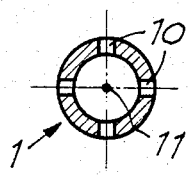
FIG. 3 shows a cross-section along the line III—III in FIG. 2.
Figure 4:
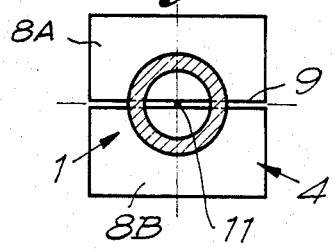
FIG. 4 shows a cross-section along the line IV—IV in FIG. 2.

The perforations 10 should preferably be distributed evenly over the wall of the tube 1. Thus, the openings 10 can be situated in axial planes with respect to the tube 1, with the axial planes being separated from each other along the length of the tube by a constant distance A, as shown in FIG. 2.

The method of operation of the weft accumulator is described in essence below.

A length of weft thread is drawn off the weft supply package 7A by the weft supply rollers 6, where the length of the weft is preferably a measured out, predetermined length, and is led by the supply rollers 6 to the air blower 2. This blower or injector 2 blows the thread 11 into the tube 1. The thread piles up in the tube at the clamp 4 so as to form coils of thread 12 against the inside wall of the tube 11.

Figure 5:
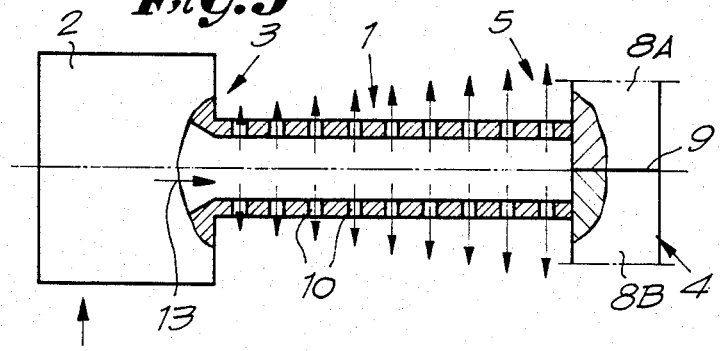

The fact that the coils of thread 12 lie neatly and evenly against the inside wall of the tube can be explained as follows. When the tube 1 is empty, as shown in FIG. 5, the airstream 13 from the airblower carries all the air to the end 5 of the tube 1 opposite the blower. It is therefore clear that, as shown schematically in FIG. 5, the greatest quantity of air escapes through the perforations 10 nearest to the clamp 4 and opposite the blower. As a result, the thread 11 inside the tube 1 begins to coil at the end 5 of the tube 1. This results in slightly less air escaping through the very last perforations, since they are blocked by the coils of thread 12. Since a greater proportion of air is thus forced to escape through the still unobstructed perforations adjacent the coiled thread in the tube, the thread 11 always comes to lie against the already formed coils 12. The coils 12 are held against the inside wall of the tube 1 by the residual air flow through the perforations 10A against which the thread 11 lies.

The warp thread 12 can then be drawn out of the tube 1 when the clamp 4 is opened.

FIG. 7 shows an embodiment of the invention in which the perforated cylindrical tube has one or more large openings or perforations 14 at the end 3 nearest the airblower 2. This avoids the situation where the air blown into the tube by the airblower 2 is not able to escape when the tube 1 is nearly full of coiled thread, and thus prevents the coils 12 from being blown over one another as a result. Excess air can always escape through the relatively large openings 14.

The preferred direction in which the thread 11 is coiled inside the tube depends on the direction of thread twist. The thread 11 is preferably coiled inside the tube 1 in a direction that partially untwists the thread. However, if the thread 11 is coiled inside the tube in the direction of the thread twist, is will not cause problems; testing has shown that the direction of the thread coils laid inside the tube will reverse spontaneously at a certain moment to a direction that untwists the weft thread.

In order to improve the airflow inside the tube 1, and in particular to encourage the weft thread 11 to coil in partial direction, special measures can be taken according to a number of preferred embodiments.

In a first embodiment to achieve this purpose, each perforation 10 in the tube forms an angle to the corresponding radius 15 of the tube, in a particular direction of rotation, as shown in the cross-section diagram in FIG. 8.

Another preferred embodiment (FIG. 9) comprises an airblower or injector which has a nozzle with a deflector element having spiral grooves 16 in order to impart a vortex motion to the airstream 13 blown into the tube 1. This vortex motion forces the weft thread 11 to coil in a particular direction.

In yet another embodiment, the warp thread 11 is encouraged to coil in a particular direction by positioning the perforations 10 in one or more spiral lines round the wall of the tube 1, for example, as shown in FIG. 10.

If the diameter of the perforated cylindrical tube 1 is made very small, in the order of 1 cm of smaller, preferably a small as 3 mm, this has the added advantage that the thread 11 is drawn out of the cylinder 1 with a minimum of resistance, thus providing a supply of weft thread for pick insertion with extremely low tension on the weft thread.

The tube 1 can of course, be made of a large number of materials. However, it is preferably made of some transparent material so that the behaviour of the thread 11 inside the tube 1 can be checked visually.

Figure 11:
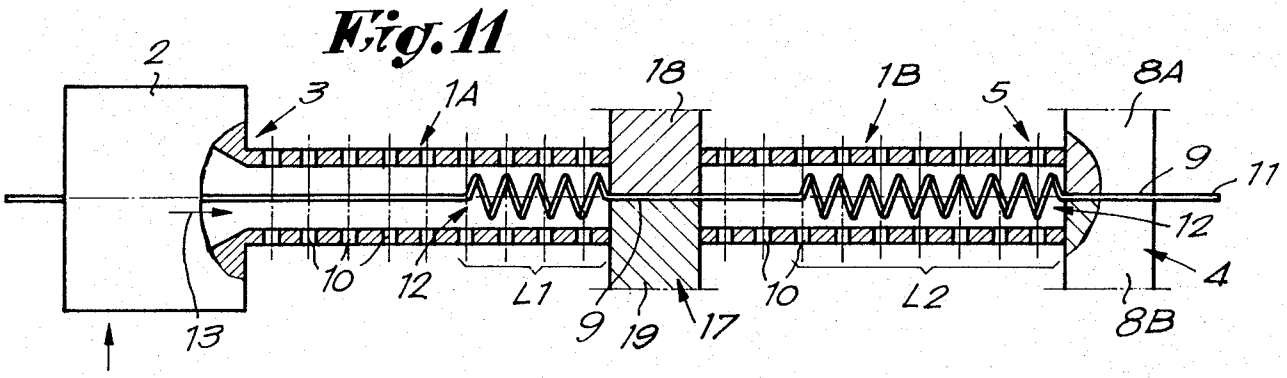
FIG. 11 shows another embodiment of the weft accumulator system of the invention, in which the cylindrical tube is divided into two parts.
Figure 12:
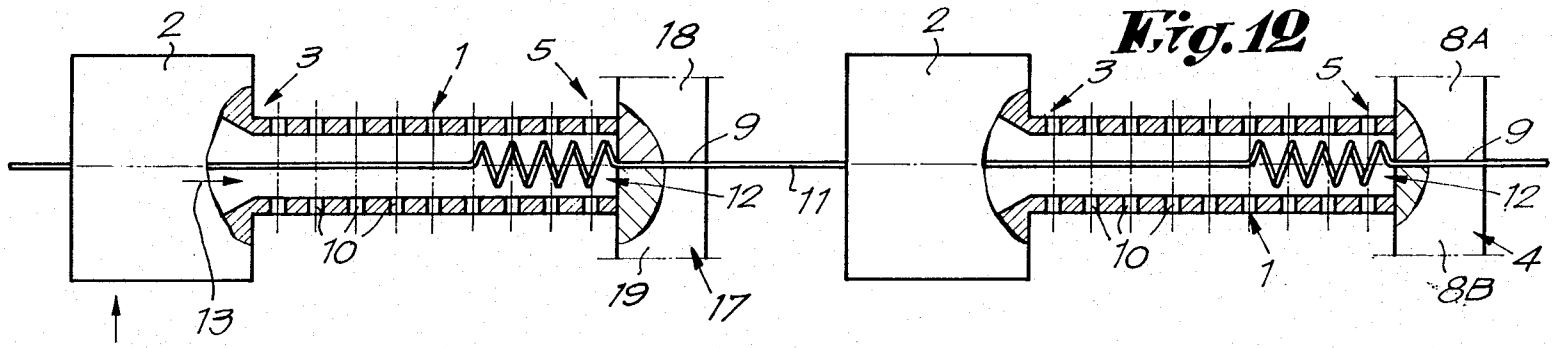
FIG. 12 shows yet another embodiment of the weft accumulator system of the invention, in which two perforated cylindrical tubes are used.

It is well known in the art that at high picking speeds the weft thread pick inserted into the shed must not be braked suddenly while it is being supplied in order to avoid breaking the weft thread. FIGS. 11 and 12 show embodiments of the weft accumulator of the present invention which offer a particular solution to this problem.

In the embodiment shown in FIG. 11, the perforated cylindrical tube 11 is divided into two in-line sections 1A and 1B by an adjustable thread brake 17 mounted approximately in the middle of the tube 1. This thread brake 17 can consist of, for example, two brake shoes 18 and 19 which form a complete closure of the tube when completely engaged.

The thread clamp 4 and the thread brake 17 are worked in such a way that the following operation cycle is repeated throughout the weaving process. When the thread clamp 4 is closed, section 1B of the cylinder is filled with coiled weft thread. At a certain moment during the filling of section 1B, the thread brake 17 is closed, so that section 1B then contains an initial length of thread 12 equal to the length of weft thread inserted into the shed during acceleration of the pick, plus the remainder of the pick inserted into the shed at normal picking speed. An additional length L1 of weft thread is next introduced into Section 1A of the cylinder 1, equal to the length which has to be inserted into the shed during the deceleration stage of the pick. To start the pick insertion, the thread clamp 4 is first opened, and the initial thread length L2 is taken from the section 1B, accelerated and led through the shed. Following the insetion of the initial thread length L2, the brake 17 exercises a relatively light braking force on the additional length of weft thread 11. This provides the necessary gradual braking of the pick when the last length of weft thread L1 to be inserted into the shed is drawn from the accumulator, i.e., the length contained in the first section 1A of the cylinder 1.

In a variation of the embodiment shown in FIG. 11, two accumulators of the type shown in FIG. 1 can be placed in series, for example, as shown in FIG. 12. However, in this case the first accumulator is fitted with a thread brake 17 and the second with a thread clamp 4.

The operation of the embodiment shown in FIG. 12 may be analogous to that of the embodiment shown in FIG. 11. In each of these figures, corresponding parts are indicated with the same numbers.

It is clear that the term "perforated cylindrical tube" must be taken to include all tubes with a circular cross-section as well as other tubes with a regularly curved inside wall, e.g., with an elliptical cross-section.

The present invention is not limited to the embodiments described herein by way of example and shown in the accompanying figures; on the contrary, such weft accumulators for weaving machines, together with their components, can be made in all forms and dimensions while still remaining within the scope of the invention.

We claim:

1. A weft accumulator assembly for accumulating a predetermined length of weft thread to be inserted into a shed of a weaving loom, the accumulator assembly comprising:

a weft thread supply;

a drawing off of means arranged to draw off a predetermined length of weft thread from said thread supply;

at least one perforated cylindrical tube;

a fluid blowing means operatively connected to a first end of said tube and arranged to receive said predetermined length of weft thread drawn off of said thread supply and blow said length of thread into said tube; and a thread clamping means operatively connected to a second end of said tube and arranged to operate in a first condition closing the second end of said tube to prevent the insertion of said predetermined length of weft thread into the shed, and a second condition opening the second end of said tube to permit the insertion of said predetermined length of weft thread into the shed.

2. A weft accumulator assembly as clamed in claim 1, wherein said thread clamping means comprises a pair of brake shoes arranged at opposite sides of said second end of said tube arranged to engage each other and close off the second end of said tube when said clamping means is operated in said first condition.

3. A weft accumulator assembly as claimed in claim 1, wherein the performations proximate the first end of said tube are larger than the perforations proximate the second end of said tube.

4. A weft accumulator assembly as claimed in claim 1, wherein the perforations in said tube extend through the tube wall at a predetermined angle to a radius of said tube.

5. A weft accumulator assembly as claimed in claim 1 wherein the perforations in said tube are distributed around the external surface of said tube in at least one spiral line.

6. A weft accumulator assembly as claimed in claim 1 wherein said fluid blowing means comprises a fluid nozzle with an internal deflector element, including spiral grooves formed in the internal deflection element of said nozzle extending in the direction of the tube axis.

7. A weft accumulator assembly as claimed in claim 1 wherein said perforated tube is divided into two coaxial sections by an adjustable weft thread braking means positioned intermediate said first and second ends of said tube.

8. A weft accumulator assembly as claimed in claim 1 wherein said perforated cylindrical tube is transparent.

9. A weft accumulator assembly as claimed in claim 1 wherein said perforated cylindrical tube has an internal diameter of at most one centimeter.

10. A weft thread accumulator assembly for accumulating a predetermined length of weft thread to be inserted into a shed of a weaving loom, the accumulator assembly comprising:

a weft thread supply;

a drawing off means arranged to draw off a predetermined length of weft thread from said thread supply;

a first perforated cylindrical tube;

a first fluid blowing means operatively connected to a first end of said tube and arranged to receive said predetermined length of weft thread drawn off of said thread supply and blow said length of thread through said first tube;

an adjustable thread braking means operatively connected to a second end of said first tube and arranged to operate in a first and second condition to close the second end of said first tube when operating in said first condition, and to open the second end of said first tube when operating in said second condition;

a second perforated cylindrical tube arranged coaxial to said first tube;

a second fluid blowing means operatively connected to a first end of said second tube and arranged to receive said predetermined length of weft thread blow through said first cylindrical tube and blow said length of weft thread through said second tube; and a thread clamping means operatively connected to the second end of said second tube and arranged to operate in a first and second condition to close the second end of said second tube when operating in said first condition, and to open the second end of said second tube when operating in said second condition.

11. A method of accumulating a predetermined length of weft thread to be inserted into a shed of a weaving loom by a pick inserting assembly, said method including:

drawing off a predetermined length of weft thread from a weft thread supply;

delivering said predetermined length of weft thread to a first end of a perforated tube;

blowing said length of weft thread into said tube by a fluid blowing means;

accumulating said predetermined length of weft thread in said tube by closing a second end of said tube, thereby preventing said weft thread from being blown out of said tube;

opening said second end of said tube after said predetermined length of weft thread has been accumulated in said tube;

and blowing said predetermined length of weft thread accumulated in said tube out of said tube to said pick inserting assembly.

12. A method as claimed in claim 11 including closing said second end of said tube by engaging a pair of brake shoes of a clamping means positioned at opposite sides of the second end of said tube, thereby closing off the second end of said tube and clamping a portion of said predetermined length of weft thread between said shoes.

13. A method as claimed in claim 11 including forming said predetermined length of weft thread accumulated in said tube into a coil, with the axis of said coil being substantially coaxial to the axis of said tube.

14. A method as claimed in claim 11, including forming said predetermined length of weft thread accumulated in said tube into a first coil accumulated in a first section of said tube, and into a second coil accumulated in a second section of said tube.

15. A method as claimed in claim 14 including restraining said first coil of said predetermined length of weft thread while said first coil is blown out of said first section of said tube by clamping said weft thread between said first and second coils in an adjustable brake means.

16. A method as claimed in claim 13 including forming said predetermined length of weft thread into a coil by engaging a pair of brake shoes for a clamping means positioned at opposite sides of the second end of said tube, thereby closing off the second end of said tube.

17. A method as claimed in claim 16 including forming said predetermined length of weft thread into a coil in said tube after closing off the second end of said tube by blowing fluid axially into said tube and radially out of the perforations of said tube.

18. A method as claimed in claim 16 including forming said predetermined length of weft thread into a coil and in said tube after closing off the second end of said tube by blowing fluid axially into said tube through spiral grooves in a nozzle of said blowing means.

* * * * *